US010895096B2

(12) United States Patent
Clark et al.

(10) Patent No.: US 10,895,096 B2
(45) Date of Patent: Jan. 19, 2021

(54) HINGE MECHANISM AND A HINGE ASSEMBLY

(71) Applicant: D & D GROUP PTY LTD, Frenchs Forest (AU)

(72) Inventors: Anthony John Clark, Cremorne (AU); Richard Escane, Dee Why (AU)

(73) Assignee: D & D GROUP PTY LTD, New South Wales (AU)

( * ) Notice: Subject to any disclaimer, the term of this patent is extended or adjusted under 35 U.S.C. 154(b) by 0 days.

(21) Appl. No.: 16/311,865

(22) PCT Filed: Jun. 27, 2017

(86) PCT No.: PCT/AU2017/050655
§ 371 (c)(1),
(2) Date: Dec. 20, 2018

(87) PCT Pub. No.: WO2018/000029
PCT Pub. Date: Jan. 4, 2018

(65) Prior Publication Data

US 2019/0203514 A1 Jul. 4, 2019

(30) Foreign Application Priority Data

Jun. 27, 2016 (AU) ..... 2016902515

(51) Int. Cl.
*E05F 1/12* (2006.01)
*E05F 3/10* (2006.01)
*E05D 11/10* (2006.01)

(52) U.S. Cl.
CPC ..... *E05F 1/1253* (2013.01); *E05D 11/1064* (2013.01); *E05F 3/104* (2013.01); *E05Y 2900/40* (2013.01)

(58) Field of Classification Search
CPC ..... E05F 1/1246; E05F 1/1253; E05F 3/104; E05D 11/1064
(Continued)

(56) References Cited

U.S. PATENT DOCUMENTS 5,121,521 A 6/1992 Hagiawara et al.
5,682,644 A 11/1997 Bohacik et al.
(Continued)

FOREIGN PATENT DOCUMENTS

AU 2013204248 12/2015
CN 1680678 A 10/2005
(Continued)

OTHER PUBLICATIONS

International Search Report for Application No. PCT/AU2017/050655 dated Aug. 1, 2017 (4 pages).
(Continued)

*Primary Examiner* — Jeffrey O'Brien
(74) *Attorney, Agent, or Firm* — Michael Best & Friedrich LLP

(57) ABSTRACT

A hinge mechanism comprising first and second members rotatable relative to one another about a hinge axis from a first to a second position; and a biasing arrangement operative to adopt an active mode to bias the first and second members into at least one relative position and operative to adopt an inactive mode where the biasing arrangement does not provide bias to the first or second members to undergo relative rotation, wherein the biasing arrangement remains in the inactive mode on relative rotation of the first and second members through a first selected angular displacement between the first position and the second position, and is in the active mode on relative rotation of the first and second members through a second selected angular displacement between the first position and the second position.

10 Claims, 9 Drawing Sheets

(58) Field of Classification Search
USPC ..... 16/54, 55, 252
See application file for complete search history.

(56) References Cited

U.S. PATENT DOCUMENTS

| | | | | |
|---|---|---|---|---|
| 5,867,869 | A * | 2/1999 | Garrett | A47K 3/36 16/252 |
| 7,305,796 | B2 * | 12/2007 | Chiang | E05D 5/0246 16/252 |
| 7,895,713 | B2 * | 3/2011 | Williams, Jr. | E05D 5/06 16/238 |
| 7,900,319 | B2 * | 3/2011 | Bacchetti | E05F 3/20 16/252 |
| 8,191,206 | B1 * | 6/2012 | Bacchetti | E05D 11/1014 16/378 |
| 8,720,005 | B2 * | 5/2014 | Cheng | E05D 5/0246 16/252 |
| 8,745,822 | B2 * | 6/2014 | Garrett | E05D 5/0246 16/252 |
| 8,863,356 | B2 * | 10/2014 | Bacchetti | E05F 3/104 16/54 |
| 8,943,652 | B2 * | 2/2015 | Bacchetti | E05F 3/20 16/378 |
| 9,140,043 | B2 * | 9/2015 | Chang | E05D 5/0246 |
| 9,387,811 | B2 * | 7/2016 | Viklund | B60R 9/055 |
| 9,482,041 | B2 * | 11/2016 | McKibben | E05F 3/227 |
| 9,567,785 | B2 * | 2/2017 | Wang | E05D 3/02 |
| 9,926,733 | B2 * | 3/2018 | Bacchetti | E05F 3/10 |
| 10,400,495 | B1 * | 9/2019 | Yu | E05F 3/10 |
| 2008/0034535 | A1 | 2/2008 | Chiang | |
| 2008/0083088 | A1 * | 4/2008 | Lin | E05D 11/1064 16/327 |
| 2008/0168621 | A1 * | 7/2008 | Lin | E05D 11/1064 16/252 |
| 2012/0216370 | A1 * | 8/2012 | Chow | E05D 5/0246 16/54 |

FOREIGN PATENT DOCUMENTS

| | | | |
|---|---|---|---|
| CN | 104631989 | A | 5/2015 |
| CN | 105283619 | A | 1/2016 |
| DE | 102006002751 | A1 | 9/2007 |
| GB | 2516638 | | 2/2015 |
| JP | 2010515843 | A | 5/2010 |
| WO | 2012049518 | | 4/2012 |
| WO | 2015015443 | | 2/2015 |

OTHER PUBLICATIONS

Translation of China National Intellectual Property Administration Search Report for Application No. 201780039544.0 dated Mar. 13, 2020 (1 page).

* cited by examiner

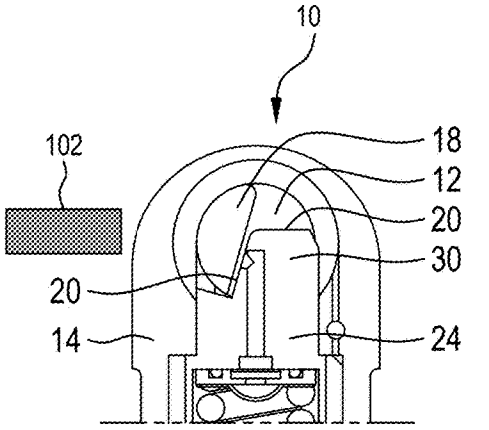
Fig. 13a
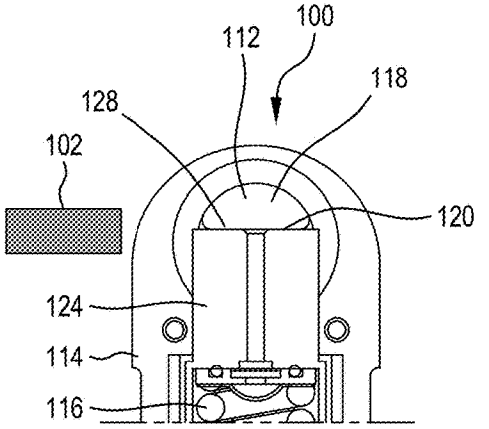
Fig. 13b - Prior Art
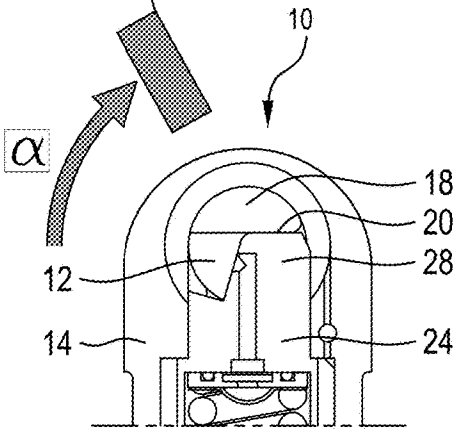
Fig. 14a
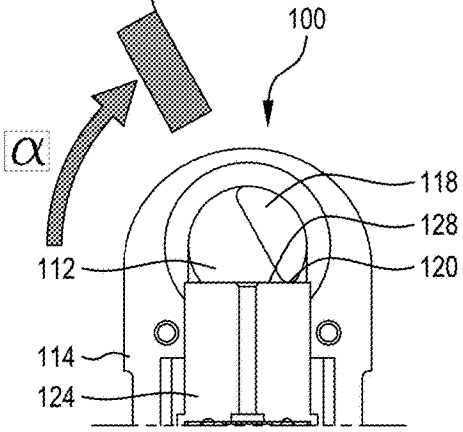
Fig. 14b - Prior Art
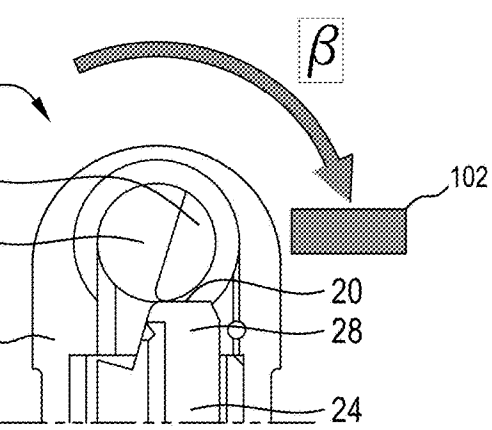
Fig. 15a
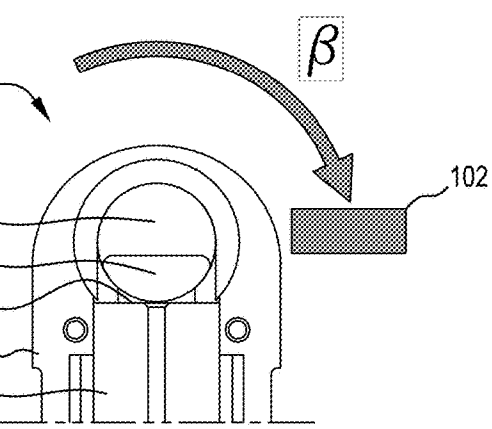
Fig. 15b - Prior Art

HINGE MECHANISM AND A HINGE ASSEMBLY

TECHNICAL FIELD

The present invention is directed towards a hinge mechanism and a hinge system. In some embodiments, the hinge mechanism and the hinge system may be used in operation on a swinging barrier, such as a gate or door etc.

BACKGROUND ART

It is beneficial in many applications to provide swinging barriers that close automatically—such as a gate in a pool, playground or preschool fence. To provide the desired force, the barrier may be supported by a hinge that exerts a closing bias. However, in some previous hinge designs the extent to which barrier may rotate in a self-closing manner may be limited by the biasing arrangement incorporated in the hinge.

Various forms of hydraulic closers have been previously proposed such as WO20120495518A1 and WO2015015443A1.

WO20120495518A1 discloses a 90° bi-directional closer with two pistons that operate on a common shaft. However, such design is complex and the shaft may be subjected high bending forces.

WO2015015443A1 discloses a single piston hydraulic closer.

Whilst the two patent documents disclose development in hydraulic closers, there has been a requirement to offer a more cost effective solution that minimises the number of complex parts, and still provide a robust solution for 180° hydraulic closers.

The above references to the background art do not constitute an admission that the art forms a part of the common general knowledge of a person of ordinary skill in the art. The above references are also not intended to limit the application of the method and system as disclosed herein.

SUMMARY

According to a first aspect, a hinge mechanism is provided comprising first and second members rotatable relative to one another about a hinge axis from a first to a second position; and a biasing arrangement operative to adopt an active mode to bias the first and second members into at least one relative position and operative to adopt an inactive mode where the biasing arrangement does not provide bias to the first or second members to undergo relative rotation, wherein the biasing arrangement remains in the inactive mode on relative rotation of the first and second members through a first selected angular displacement between the first position and the second position, and is in the active mode on relative rotation of the first and second members through a second selected angular displacement between the first position and the second position.

According to a second aspect, there is provided a hinge mechanism comprising first and second members rotatable relative to one another about a hinge axis from a first to a second position, and a biasing arrangement operative in an active mode to bias the first and second members into at least one relative position, the biasing arrangement comprises a cam surface disposed on the first member and the second member includes a drive arrangement, the drive arrangement comprising a biasing device and a drive member which is biased into an extended position by the biasing device and movable from the extended position against the bias of the biasing device, the drive member including an engagement surface which is operative to contact the cam surface during relative rotation of the first and second members and, during at least one selected angular displacement between the first and second positions, the contact between the cam surface and the engagement surface causes the drive member to move from the extended position, wherein when the drive member is in the extended position the biasing arrangement is in an inactive mode such that it does not provide bias to the first or second members to undergo relative rotation, wherein the engagement surface is profiled to include a recess to accommodate at least a portion of a cam having the cam surface to allow rotation of the cam relative to the engagement surface without biasing the drive member from the extended position such that the biasing arrangement remains in the inactive mode on relative rotation of the first and second members through a first selected angular displacement and is in the active mode to bias the first and second members into at least one relative position through a second selected angular displacement.

According to a third aspect, there is provided a hinge system comprising first and second hinge mechanisms for a barrier, each hinge mechanism comprising first and second members rotatable relative to one another about a hinge axis, one of the first or second members of each hinge mechanism being connected to the barrier and the other being connected to a supporting structure such that the barrier can rotate about the hinge axis, the hinge mechanisms each including a biasing arrangement operative in an active mode to bias their respective first and second members into a least one relative position and at least the first hinge mechanism is operative to adopt an inactive mode, where it does not provide bias to the first or second members to undergo relative rotation, through a selected angular displacement of the first and second members about the hinge axis, wherein the first and second hinge mechanisms are configured such that on rotation of the barrier about the hinge axis from the first position to the second position, at least one of the hinges mechanisms remain active to bias the barrier to return to the first position and wherein through a particular angular displacement between the first position and the second position at least the first hinge mechanism remains inactive.

BRIEF DESCRIPTION OF THE DRAWINGS

Embodiments of the present disclosure will now be described with reference with the accompanying figures in which:

FIGS. 13*a* and 13*b* are cross-sectional view of one embodiment of top and bottom hinges of the hinge assembly of FIG. 12 in a first position;

FIGS. 14*a* and 14*b* are cross-sectional view of one embodiment of top and bottom hinges of the hinge assembly of FIG. 12 in an intermediate position;

FIGS. 15*a* and 15*b* are cross-sectional view of one embodiment of top and bottom hinges of the hinge assembly of FIG. 12 in a second position.

DETAILED DESCRIPTION OF THE DRAWINGS

Figure 1:
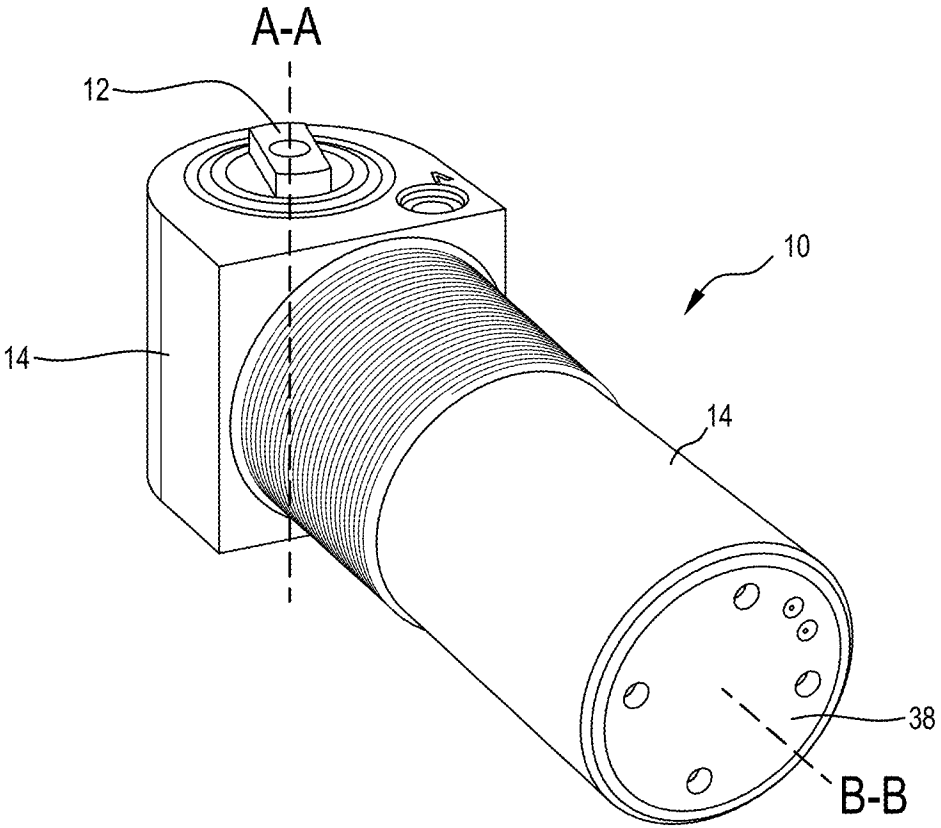
FIG. 1 is a perspective view of one embodiment of a hinge mechanism.

In the following description, functionally similar parts carry the same reference numerals between different embodiments. The drawings are intended to be schematic, and dimensions, scale and/or angles may not be determined accurately from them unless otherwise stated.

Within the disclosure, unless otherwise stated, the term gate includes, for example, a movable barrier, hatch, gate, door, skylight or window, i.e. a member suitable for closing or opening an aperture, but not limited to the pivotal or direction of movement. For example, the member may pivot horizontally and/or vertically.

Figure 2:
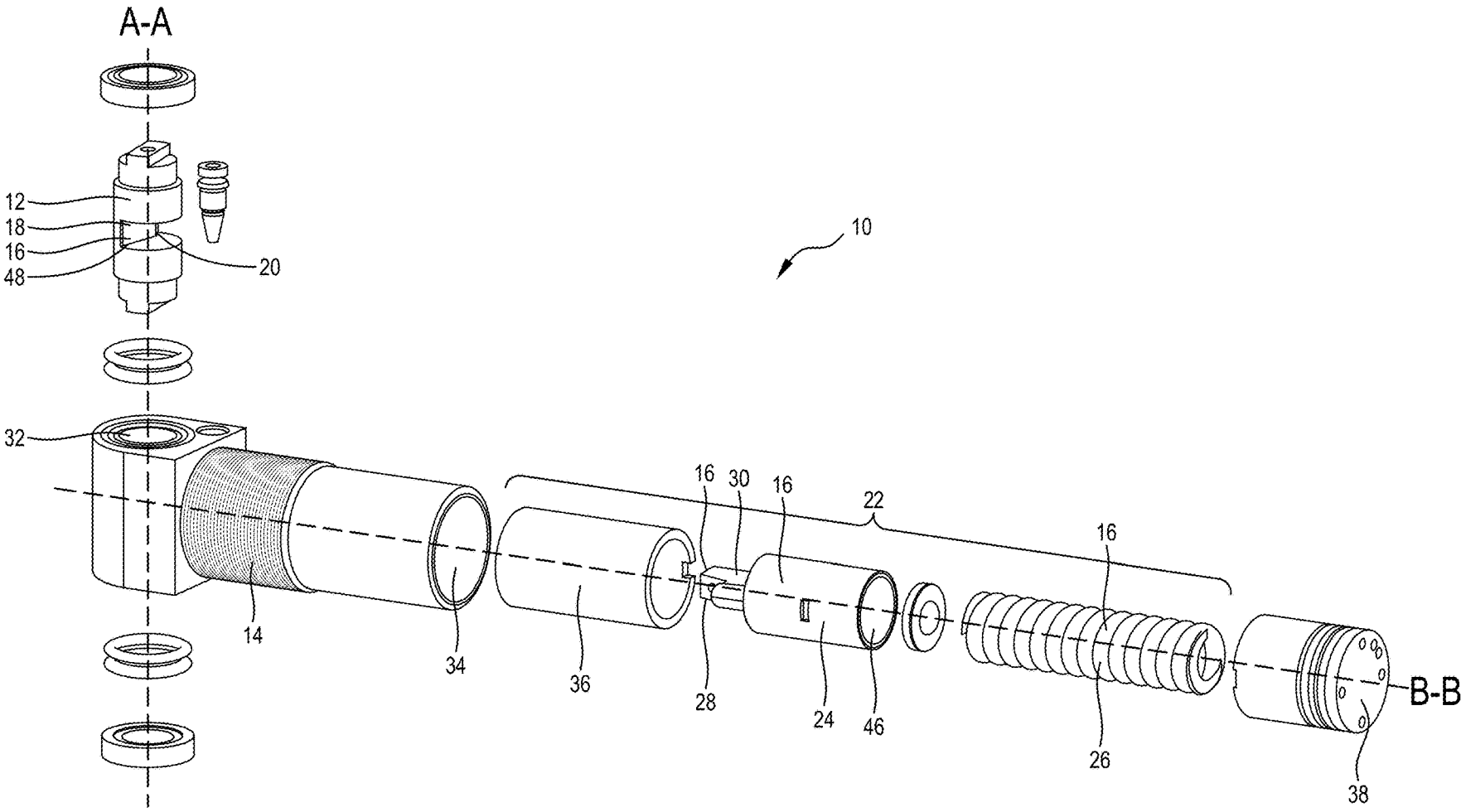
FIG. 2 is an exploded perspective view of the hinge mechanism of FIG. 1.
Figure 3:
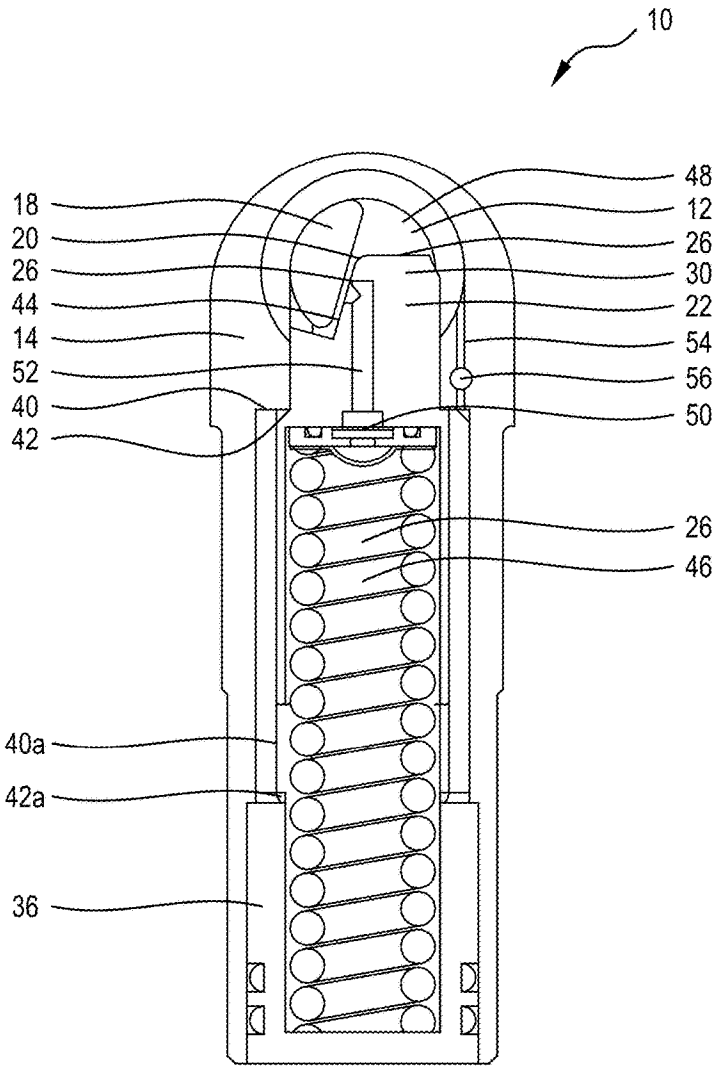
FIG. 3 is a cross-sectional view the hinge mechanism of FIG. 1.
Figure 12:
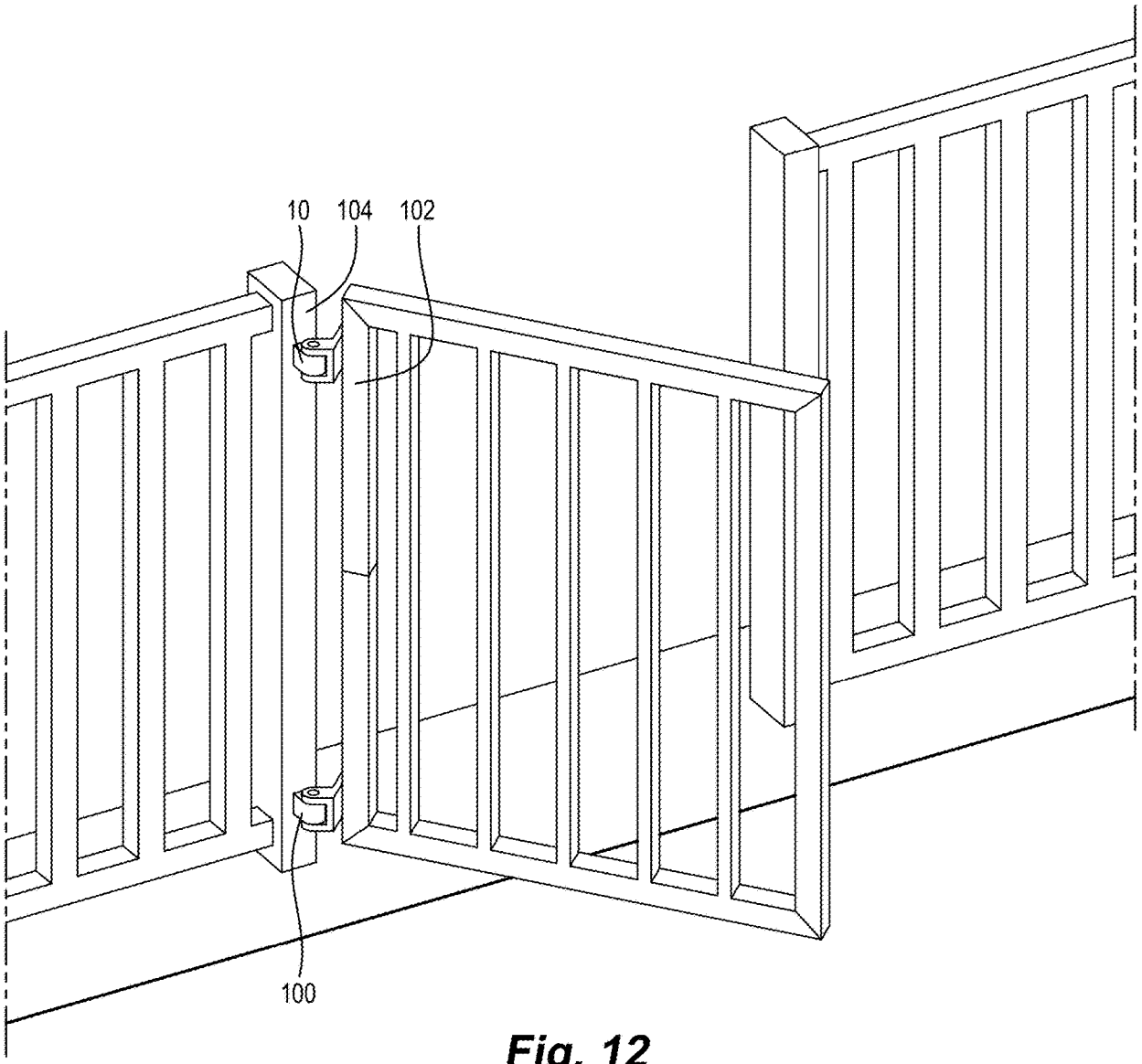
FIG. 12 is a side view of one embodiment of a hinge assembly.

FIG. 1 is a perspective view of one embodiment of a hinge mechanism generally indicated by the numeral 10. FIG. 2 is an exploded perspective view of the hinge mechanism 10 according to FIG. 1, and FIG. 3 is a cross-sectional view of the hinge mechanism 10 along section A-A as shown in FIG. 1. The hinge mechanism is typically used in respect of gates (as shown in FIG. 12) but may be used in other applications for other movable barriers (such as doors and the like).

The hinge mechanism 10 has two hinge parts 12 and 14 which are rotatable relative to one another about a hinge axis A-A. In the illustrated embodiment, the one hinge part is in the form of a shaft 12 and the other hinge part is in the form of a housing 14. The shaft 12 and the housing 14 rotate relative to each other about the hinge axis A-A that extends longitudinally through the centre of the shaft 12.

The hinge 10 is designed to provide a bias to rotation of the shaft 12 within the housing 14. With reference to FIGS. 2 and 3, the hinge mechanism 10 also includes a biasing arrangement 16 that has two modes, an inactive mode and an active mode. During rotation of the shaft 12 within the housing 14, the biasing arrangement 16 is arranged such that, through a selected angular displacement $\alpha$, the biasing arrangement 16 is inactive (and does not provide any bias on the shaft 12) and through another selected angular displacement $\beta$ the biasing arrangement 16 is active (and does provide bias on the hinge mechanism 10).

The biasing arrangement 16 includes a cam 18 having a cam surface 20 which, in the illustrated form, forms part on the shaft 12, and the housing 14 includes a drive arrangement 22. In the illustrated embodiment, the drive arrangement 22 is mounted within the housing 14. In alternative embodiments, the drive arrangement may be mounted external the housing or mounted partially within the housing. The drive arrangement 22 as shown is in the form of a piston cylinder arrangement and includes a piston 24 that is disposed substantially perpendicular to the cam surface 20 (although it is to be appreciated that other orientations are possible). The drive arrangement 22 includes a biasing device 26 (in the form of a spring) and the piston 24 includes an engagement surface 28 at its distal end 30 that contacts the cam surface 20 during relative rotation of the shaft 12 and the housing 14.

Figure 4:
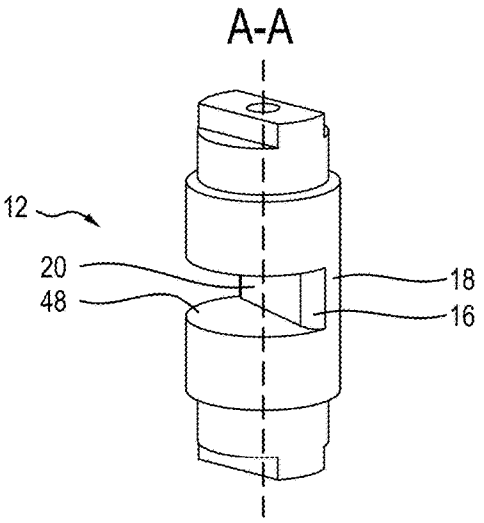
FIG. 4 is a perspective view of one embodiment of a cam arrangement of the hinge mechanism of FIG. 1.

The shaft 12 is shown in an enlarged perspective view FIG. 4, and is shown positioned in a cylindrical receptacle 32 in the housing 14 in FIG. 2. The shaft 12 includes a recessed centre portion that forms the cam 18 having the cam surface 20. In the illustrated embodiment, the cam 18 is generally a semi-circular shape, although it is non-symmetrical having a smaller radius on one side of the cam 18 (best shown in FIG. 3). The cam surface 20, which is arranged to contact the engagement surface 28 of the piston 24, is provided along the generally flat surface of the semi-circle and extends around one corner of the cam 18 between the flat surface and the arc of the cam 18. However, it is understood that the cam 18 may be other than that shown as will be appreciated from the relationship between the cam surface 20 and the engagement surface 28 as will be discussed in more detail below.

Figure 5:
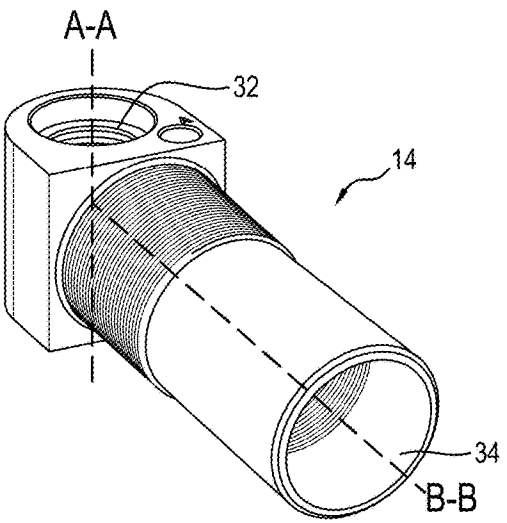
FIG. 5 is a perspective view of one embodiment of a housing of the hinge mechanism of FIG. 1.

FIG. 5 illustrates the housing 14 which receives both the shaft 12 and the drive arrangement 22. The shaft 12 extends through the cylindrical receptacle 32 in the housing 14 extending along the hinge axis A-A, and the ends of the shaft 12 are accessible to be attached to a gate frame bracket (see FIG. 12). The drive arrangement 22 extends along an axis B-B which is transverse to the hinge axis A-A in a second cylindrical receptacle 34 such that the drive arrangement 22 can apply bias to the cam surface 20.

Figure 7:
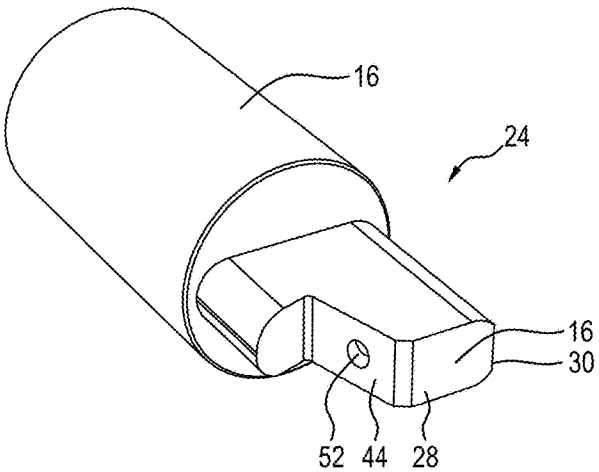
FIG. 7 is a perspective view of one embodiment of a piston of a drive arrangement of the hinge mechanism of FIG. 1
Figure 6:
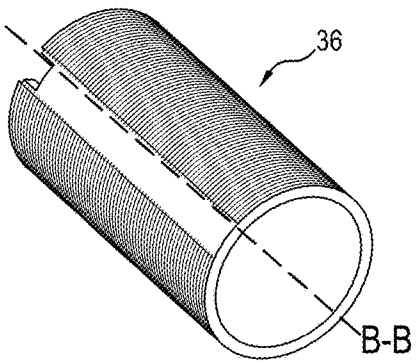
FIG. 6 is a perspective view of one embodiment of a piston cylinder of a drive arrangement of the hinge mechanism of FIG. 1.

FIGS. 6 and 7 illustrate parts of the drive arrangement 22. FIG. 6 illustrates a cylinder 36 which is inserted into a cylindrical receptacle 36 in the housing 14. The biasing device which is inserted into a cylindrical receptacle 34 in the housing 14. The biasing device (spring) 26 is positioned in an internal bore in the cylinder 36. The piston 24 is positioned in the cylinder 36 and movable in relation to the cylinder 36 against the bias of the spring 26. The engagement surface 28 is disposed at the distal end 30 of the piston 24. An end cap 38 is releasably secured to an open end of the housing 14 to enclose the drive components within the housing 14.

In general, the engagement surface 28 is arranged to be biased by the spring 26 into the cylindrical receptacle 34 so as to be able to contact the cam surface 20. However, the extent of the movement of the piston 24 towards the cam surface 20 is limited by engagement of a shoulder 40 of the piston 24 with a ledge 42 formed on the housing 14 (as shown in FIG. 3). When in this position, the drive arrangement 22 is in an extended position and the piston 24 is able to retract from this extended position by compression of the spring 26. Whilst the illustrated arrangement has the biasing device 26 as a compression spring, it is to be appreciated that other suitable biasing means, such as a compression bar, compression fibre, a piece of elastomer or rubber material, magnetic elements etc. may be used.

As described above, the biasing arrangement 16 is arranged to operate in an active and an inactive mode. This is determined by the contact of the engagement surface 28 with the cam surface 20 and/or the relative position of the piston 24. In the illustrated embodiment, the engagement surface 28 is profiled to define a recessed portion 44. The recessed portion 44 may be formed between the engagement surface 28 and an internal wall of the cylinder 36. The recessed portion 44 which is shaped to receive the cam surface 20 when the shaft 12 is in a specific orientation and the piston 24 is in the extended position. Moreover, because of the recessed portion 44, the shaft 12 is able to freely rotate relative to the engagement surface 28 through an angular displacement α without the cam surface 20 contacting the engagement surface 28. In this way the biasing arrangement 16 remains inactive during that angular displacement α.

In the active mode, the piston 24 is moved from its extended position through contact of the engagement surface 28 with the cam surface 20 and the resulting biasing force applied to the cam surface 20 by the compression of the biasing device 26 is such that it induces a torsional force on the cam surface 20 to cause it to rotate. This occurs through a second angular displacement β of the shaft 12 relative to the housing 14. To create this torsional force, the point of loading being applied to the cam surface 20 by engagement with the engagement surface 28 needs to be offset from the hinge axis A-A. The operation of the biasing arrangement 16 in these active and inactive modes is best shown in relation to FIGS. 8 to 11.

Figure 8:
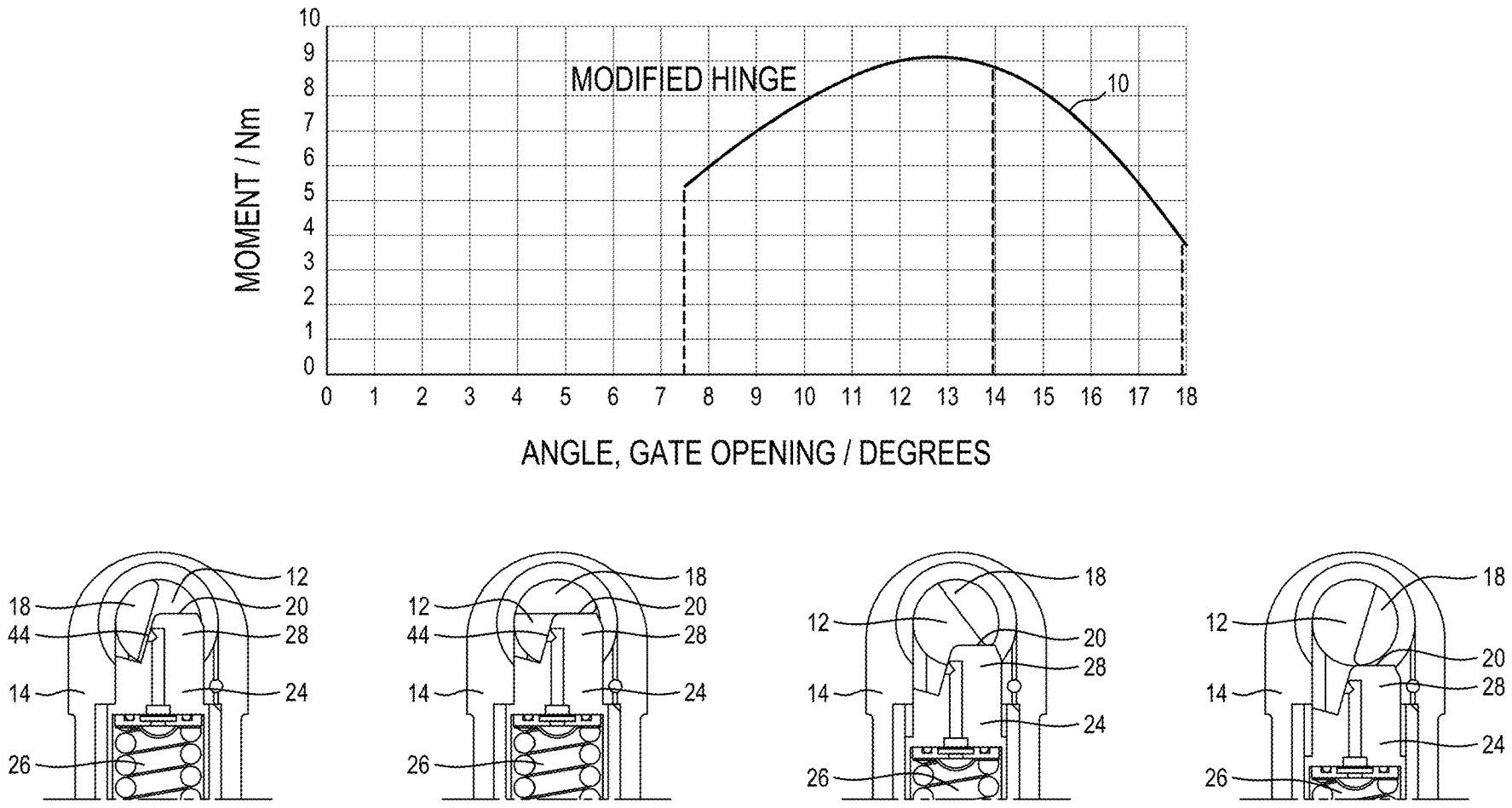
FIG. 8 is a graph of one embodiment of inactive and active modes of a biasing arrangement with reference to the respective cross-section of the hinge mechanism of FIG. 1.

FIG. 8 depicts the biasing force provided by the biasing arrangement 16 in relation to the hinge rotation with reference to the respective cross-section of the hinge mechanism 10. In the graph of FIG. 8, the first selected angular displacement α may be from 0 to 75°. Through the first selected angular displacement α, the cam 18 may be able to rotate freely in relation to the engagement surface of the piston 24. The biasing arrangement 16 is inactive and does not provide any bias on the shaft 12. The second selected angular displacement β is illustrated from 75° to 180°. Through the second selected angular displacement β, the cam 18 is in contact with the engagement surface 28, and driving the piston 24 from the extended position such that the biasing device 26 is under compression and the biasing arrangement 16 does provide bias on the shaft 12 of the hinge 10.

Figure 10:
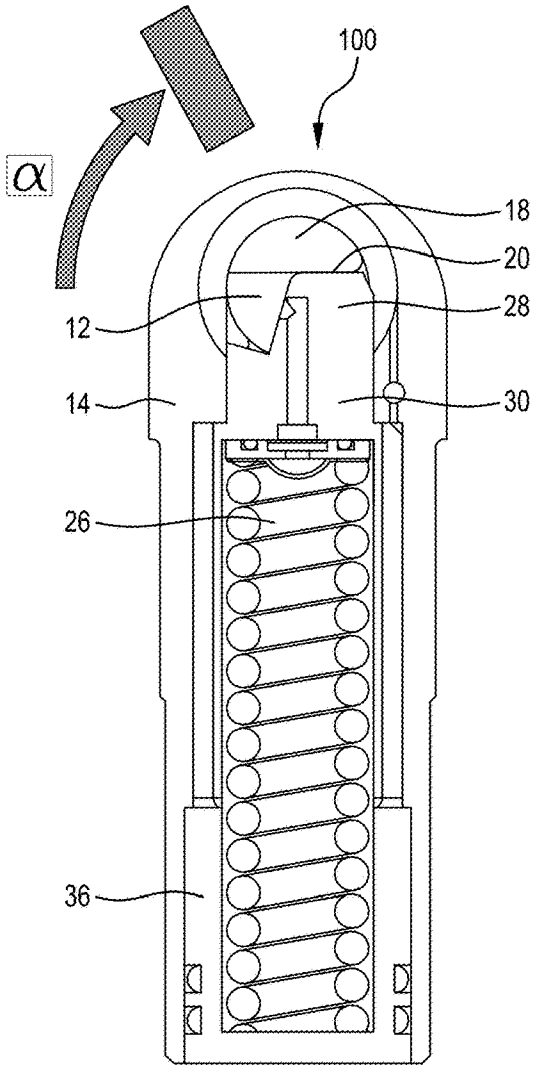
FIG. 10 is a cross-sectional view of the hinge mechanism of FIG. 1 in an intermediate position.
Figure 9:
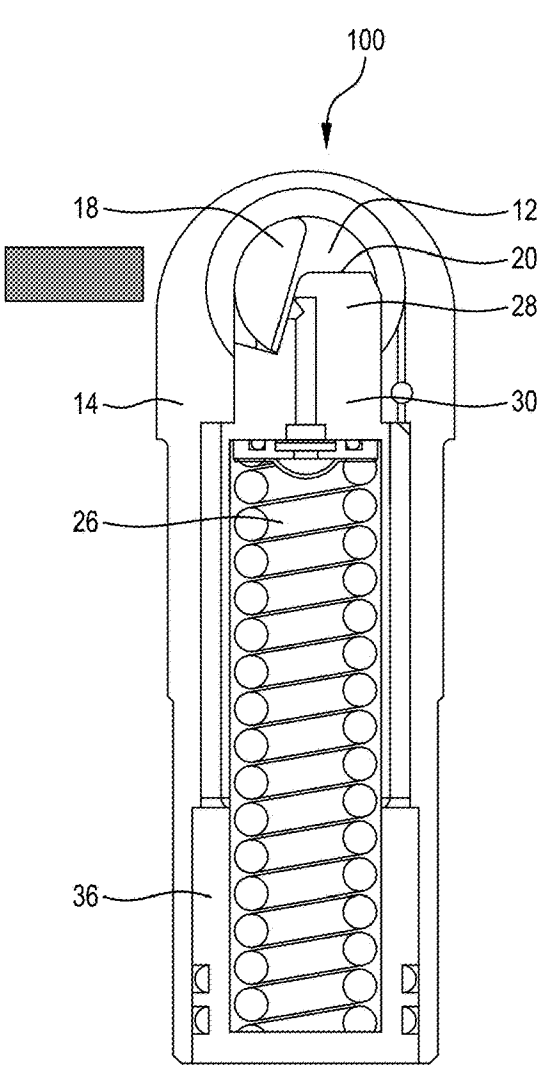
FIG. 9 is a cross-sectional view of the hinge mechanism of FIG. 1 in a first position.

FIG. 9 illustrates the hinge mechanism 10 in a first position. In the first position, the cam surface 20 and the engagement surface 28 in either spaced relation or in contact, and if they are in contact, there is no loading between the surfaces 20, 28. The cam 18 is able to rotate freely in relation to the piston 24 to an intermediate position as shown in FIG. 10. The piston 24 and the biasing device 26 are in an extended position which is the rest position (i.e., the biasing device 26 is not compressed). In this position, the piston 24 and the biasing device 26 do not provide bias to the shaft 12 to undergo relative rotation to the housing 14. The biasing device 26 is its maximum length and under no compression.

FIG. 10 illustrates the intermediate position of the shaft 12 partly rotated relative to the housing 14. In the intermediate position, the cam surface 20 is in its initial point of contact with the engagement surface 28, and any further rotational movement of the cam 18 (and the shaft 12) will be resisted by the piston 24 (as it will need to retract against the bias of the spring 26 to accommodate this further rotation). In the intermediate position, the piston 24 is still in the extended position.

Accordingly, the biasing arrangement 16 remains in the inactive mode on relative rotation of the shaft 12 and the housing 14 through the first selected angular displacement α between the first position to the intermediate position. The cam 18 is able to freely rotate in the inactive mode. Because of the shape of the cam surface 20 and the shape or profile of the engagement surface 28, the cam 18 is able to freely rotate during the first selected angular displacement α. The cam surface 20 and the engagement surface 28 may or may not be in contact when moving between the first position and the intermediate position and if the surfaces 20, 28 are in contact, there is no loading between the surfaces 20, 28. Once the shaft 12 and the housing 14 are in the intermediate position, the cam surface 20 and the engagement surface 28 are in contact. In some embodiments, the first selected angular displacement α may be greater than 10°, or less than 85°, and in some embodiments, may be in the range of about, 0 to 70°, 0 to 80°, 0 to 85°. In the illustrated embodiment, the first selected angular displacement is about 0 to 75°.

In an alternative embodiment the cam surface and the engagement surface may be a different shape entirely, for example, the cam surface may be in the form of a segment. In this alternative embodiment, the selected angular displacement in the inactive mode may be through a middle range of the 0 to 180° rotation, for example, the selection angular displacement may be anywhere in the range of about 40° to 130°. In a further embodiment, the engagement surface may be flat, and used in combination with a cam surface that has a small radius positioned towards the edge of the shaft circumference. Alternatively, the profile and/or cross section of the cam 18 may be reduced such that the area of the recessed portion 44 of the piston 24 may also be reduced accordingly, or vice versa. Further still, the hinge mechanism may also be inverted, the bias would be provided in the counter-clockwise direction rather than the clockwise direction as shown. In this alternative embodiment, the inactive mode would be through a selected angular displace of about 105° to 180°.

Figure 11:
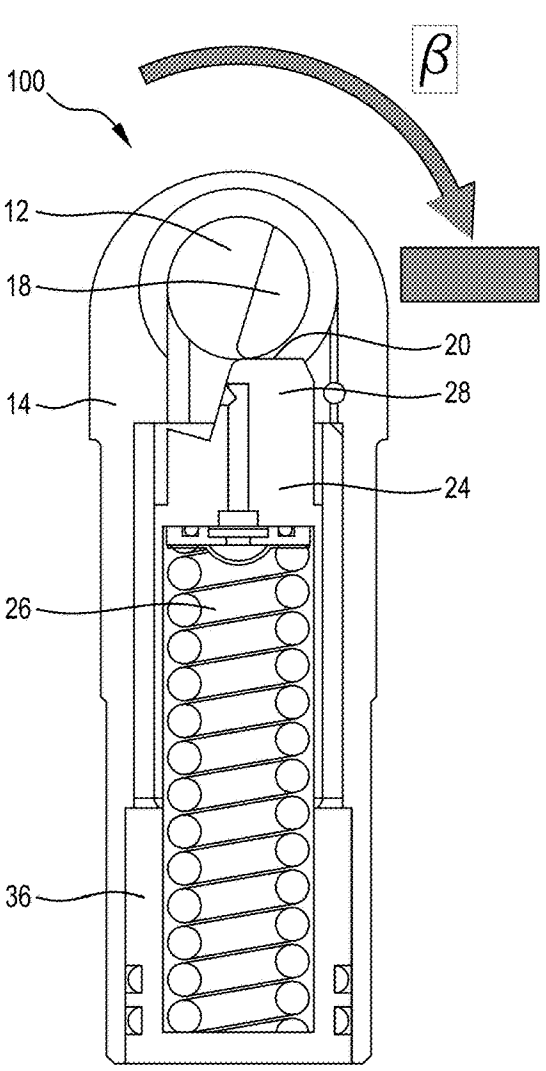
FIG. 11 is a cross-sectional view of the hinge mechanism of FIG. 1 in a second position.

FIG. 11 illustrates the hinge mechanism 10 in a second position. In the second position as illustrated, the shaft 12 has been rotated to 180° relative to the housing 14 and cannot rotate any further, for example, a lower shoulder **40*a* of the piston 24 may abut a lower ledge 42*a* formed on the internal bore in the cylinder 36 and prevents further travel of either or both the cam 18 or piston 24. During this relative rotation of the shaft 12 and the housing 14 between the intermediate position and the second position, the hinge mechanism 10 is in the active mode and rotates through the second selected angular displacement β. In operation, a rotational force is applied to the shaft 12 to rotate. As a result of the contact between the cam surface 20 and the engagement surface 28, the opening of the gate causes the cam surface 20 to activate the biasing device 26 and the piston 24 and drive the piston 24 from the extended position against the bias of the biasing device 26. The piston 24 and the biasing device 26 are moved from their extended position and the biasing device 26 imparts a torque force (or a moment of force) on the cam surface 20 via the engagement surface 28 of the piston 24. The distance that the cam surface 20 is offset from the hinge axis A-A in combination with the force of the biasing device 26 induces a moment on the cam surface 20 to bias the shaft 12 back to the intermediate position. Typically in this second position, the biasing device 26** is its minimum length and maximum compression.

Whilst the above arrangement has the first and second positions angularly displaced by 180° it is to be appreciated that sweep of the hinge may be greater or less depending on design requirements.

A benefit of the hinge mechanism 10 as described above that can operate in an active and inactive mode is that it can be used in conjunction with similar type hinge mechanisms 100 (including a similar biasing arrangement but which does not allow for an inactive mode) so as to extend the sweep of the combined hinges to bias a barrier utilising the hinges into a specific position whilst maintaining a desired resistance loading on the gate (i.e. not providing too much force on the barrier at any one angular displacement). Such an arrangement is disclosed with reference to FIGS. 12 to 16, where the combined hinge mechanisms are shown connected to a gate to provide a bias to the gate (typically to close the gate) through a sweep of 180°.

The hinge mechanism 10 also includes a hydraulic damping system (as shown best in FIG. 3) which controls the movement of the shaft 12 in relation to the housing 14 by the biasing arrangement 16 upon closing of the barrier. The hydraulic damping system includes a fluid that is contained within the hinge mechanism 10 and flows between a first chamber 46 inside the piston 24 and a second chamber 48 formed in the shaft 12 proximal the cam 18. During rotation of the shaft 12 in relation to the housing 14 upon opening of the gate, the piston 24 is driven from the expanded position by the cam 18. The volume in the first chamber 46 is reduced and the fluid is forced to travel from the first chamber 46 to the second chamber 48 about the cam 18. The fluid travels through a one-way valve 50 positioned in the distal end 30 of the piston 24 through a fluid channel 52 to the second chamber 48, and may go through a second fluid channel 54 outside the piston wall to the recess 48.

During return rotation of the shaft 12 in relation to the housing 14 upon closing of the gate, the piston 24 is biased to the expanded position and the volume in the first chamber 46 increases. The fluid then travels from the second chamber 48 about the cam 18 back to the first chamber 46 through the second fluid channel 54.

In the illustrated embodiment, the second fluid channel 54 includes a flow restrictor 56 to adjust (e.g. to reduce) the rate of flow of the fluid from the second chamber 48 to the first chamber 46. However, in alternative embodiments, the size (e.g., cross-section) of the first and/or the second fluid channel 52, 54 may be adjusted to control (e.g., reduce) the rate of flow of the fluid through the channel(s) 52, 54.

FIG. 12 shows an assembly view of one embodiment of two hinge mechanisms 10, 100 in operation on a gate 102 mounted to a post 104. Other possible structures may include a door mounted to a door frame. In the illustrated embodiment, the first hinge mechanism 10 is positioned at the top, and the second hinge mechanism 100 is positioned at the bottom. The relative position of the first and second hinge mechanisms 10, 100 may be reversed by, for example, positioned the second hinge 100 on the top and the first hinge 10 on the bottom and so the use of "left" and "right", "top" and "bottom" is for reference only. Like reference numerals are used for like features. Further, the relative position of the hinge mechanism members may be reversed by fixing each first member 12, 112 to the post frame, and fixing each second member 14, 114 to the gate frame. Moreover, the hinge mechanisms could be incorporated in a common housing such that they are formed in a single hinge (having two hinge mechanisms).

The first hinge mechanism 10 is the same as the hinge mechanism 10 illustrated in FIGS. 1 to 11 and described in detail above. The second hinge mechanism 100 is a known hinge that works together with the first hinge mechanism 10 to provide automatic closing of the gate from 0 to 180°. This combination is advantageous because it provides self-closure of the gate through a broad range of rotational movement and has no holding points where there is no bias provided on the hinge mechanism 100. This known hinge 100 is able to provide a biasing force through a sweep of 90° and is orientated in the arrangement as shown to provide a biasing force from 0 to 90°. The first hinge 10 is able to provide a biasing force from about 70° to 180°. The combination is that there is a biasing force acting on the gate from 0 to 180°.

Each of the hinge members 12, 112 and 14, 114 have a respective bracket for fixing the members to the respective structure. The first member 12, 112 of each hinge mechanism 10, 100 is fixed to the gate frame 102 (moveable) and the second member 14, 114 of each hinge 10, 100 is typically fixed to the post frame 104 (supporting structure). In operation, each of the first 12, 112 and second 14, 114 members are mounted to the gate 102 and post 104 to cooperate to control the pivotal movement of the gate 102 about the hinge axis A-A during both opening and closing of the gate 102.

FIGS. 13*a* to 15*b* illustrate how the hinge mechanisms 10, 100 work together. The first and second hinge mechanisms 10, 100 are configured such that on rotation of the barrier 102 about the hinge axis A-A from the first position to the second position, at least one of the hinge mechanisms 10, 100 remain active to bias the barrier 102 to return to the first position.

The top hinge mechanism 10 operates as discussed above in relation to FIGS. 9, 10 and 11, which correspond respectively to FIGS. 13*a*, 14*a*, and 15*a*. The bottom hinge mechanism 100 shown in FIGS. 13*b*, 14*b*, and 15*b* includes its biasing arrangement 26 compressed to varying degrees.

FIGS. 13*a* and 13*b* illustrate the top and bottom hinge mechanisms 10, 100 when the gate is in the closed position and the hinge mechanisms 10, 100 are in their first position. The bottom hinge 100 has a biasing arrangement 116 that also includes a cam 118 having a flat cam surface 120, and a drive arrangement 122 having a piston 124 and a biasing device 126. The piston 124 includes an engagement surface 128 that is also a flat surface. The cam surface 118 contacts the engagement surface 128 to drive the piston 124 from the extended position against its bias. The primary difference between the top hinge 10 and the bottom hinge 100 is the biasing arrangement 116 is active in all FIGS. 13*b*, 14*b* and 15*b* as a result of the shape of the cam 118 and the contact between the cam surface 120 and the flat engagement surface 128.

In FIG. 13*b*, the biasing device 126 is compressed slightly by the cam surface 120 being in contact with the engagement surface 128 and may allow a gap between a shoulder 140 of the piston 124 and a ledge 142 of the housing. This may allow the gate 102 to return to the closed position, but may also provide some initial resistance when the user opens the gate 102. Although the biasing device 126 is compressed by the distance, it is in its maximum length and minimum compression in this position.

In FIG. 14*b*, the gate 102 is in the partly open position during gate opening. Again, this is the point between the first position and the second position that is known as the intermediate position. At this intermediate position, the cam surface 120 of the hinge mechanism 100 is in contact with the engagement surface 128 and has been rotated approximately 75° driving the piston 124 from the extended position and compressing the biasing device 126 which provides a bias to self-close the gate. During this rotation from 0 to 75°, the cam surface 120 is offset from the hinge axis by a distance, so as to induce a moment (or torque) on the cam surface 120 to bias the shaft 112 and housing 114 into relative rotation. Indeed, this moment on the cam surface 120 is sufficient to bias the shaft 112 and the housing 114 into relative rotation from an angular displacement of about 0 to 90°. The biasing arrangement 126 in the second hinge mechanism 100 is active through the angular displacement of about 0 to 90°.

Simultaneously, in FIG. 14*a*, during this rotation from 0 to 75°, the biasing arrangement 126 is inactive and the shaft 112 is able to freely rotate in relation to the housing 114.

In FIG. 15*b*, the gate 102 is fully open. This is the second position. From FIG. 14*b* to FIG. 15*b*, the shaft 112 is rotated through a second selected angular displacement of about 75° to 180°. During the rotation of the shaft 112 and the housing 114 from the intermediate position towards the second position, through the angular displacement from about 75° to 90°, the biasing arrangement 126 of the second hinge mechanism 100 is active as discussed above. Simultaneously, from the angular displacement of about 75° to 90°, the biasing arrangement 26 of the first hinge mechanism 10 is also active.

During rotation from about 90° to 180°, the biasing arrangement 126 of the second hinge mechanism 100 has adopted a passive mode. In the passive mode, the piston 124 is moved from its extended position and the piston 124 imparts a force to the cam surface 120 that is substantially aligned with the hinge axis such that it does not induce a sufficient moment on the cam surface 120 to bias the first 112 and second 114 members into relative rotation. Simultaneously, the biasing arrangement 126 of the first hinge mechanism 10 is active from 90° to 180°.

Figure 16:
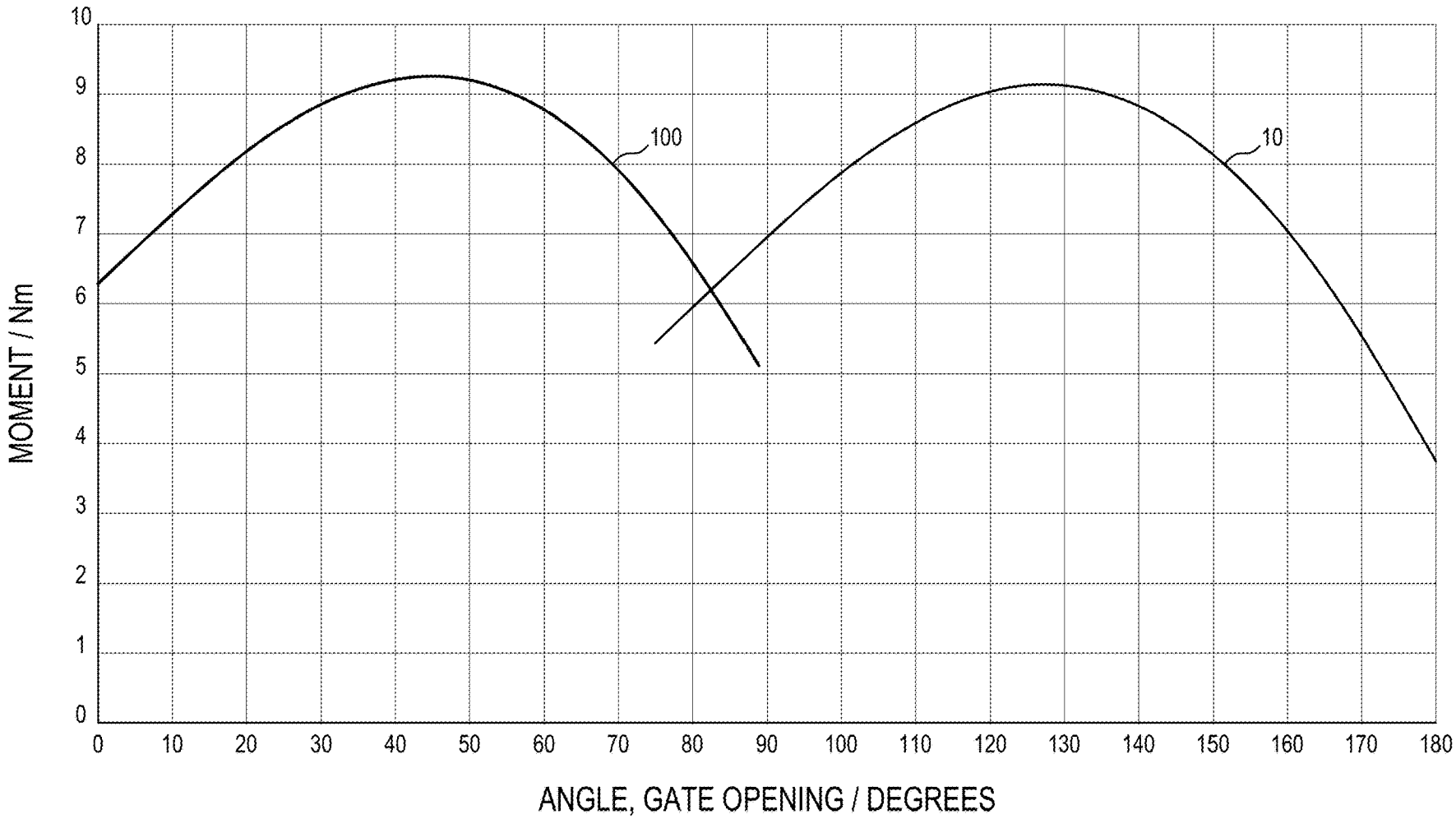
FIG. 16 is a graph that depicts torque (moment/Nm) against angular displacement (degrees) of one embodiment of the hinge system of FIG. 10 in relation to rotational movement.

FIG. 16 is a graph that illustrates the angular displacement of the shaft 12, 112 relative to the housing of each hinge mechanisms 10, 100 over the entire rotational movement from 0 to 180°. The graph shows the torque applied by the hinges over the 180° angular displacement. In alternative embodiments, it is understood that the moment scale depicted in the graph may vary depending on the specific hinge mechanism and the gate.

Specific features of the torque profile shown by the combined hinge mechanisms 10, 100 are as follows:

1. There is a torque force to bias the gate to the closed position (0) through the full sweep of 0-180°
2. There is no "doubling up" of the torque from the hinge mechanisms except in mid area of the sweep (70-110°) where the individual torque being applied is low compared to its peak torque
3. The start and end positions have lower torque than in the mid part of the sweep. This is advantageous as it means the initial force required to open the gate is not too excessive, nor is the torque required to keep open the gate in the fully open position too great.

It can be appreciated during opening of the gate, the cam(s) 18, 118 may be considered as the driver and the piston(s) 24, 124 become the driven. During the reverse, i.e. closing of the gate, the piston(s) 24, 124 may be considered as the driver and the cam(s) 18, 118 become the driven.

EMBODIMENTS

Embodiment 1

According to one embodiment, there is provided a hinge mechanism comprising:

first and second members rotatable relative to one another about a hinge axis from a first to a second position; and a biasing arrangement operative to adopt an active mode to bias the first and second members into at least one relative position and operative to adopt an inactive mode where the biasing arrangement does not provide bias to the first or second members to undergo relative rotation, wherein the biasing arrangement remains in the inactive mode on relative rotation of the first and second members through a first selected angular displacement between the first position and the second position, and is in the active mode on relative rotation of the first and second members through a second selected angular displacement between the first position and the second position.

Embodiment 2

A hinge mechanism according to embodiment 1, wherein the biasing arrangement remains in the inactive mode on relative rotation of the first and second members through a first angular displacement from the first position to an intermediate position and becomes active to bias the first and second members to the intermediate position on continued relative rotation of the first and second members through a second angular displacement from the intermediate position towards the second position.

Embodiment 3

A hinge mechanism according to embodiment 1 or 2, wherein the biasing arrangement comprises a cam surface and a drive arrangement, the cam surface being disposed on the first member and the second member including the drive arrangement, the drive arrangement comprising a biasing device and a drive member which is biased into an extended position by the biasing device and movable from the extended position against the bias of the biasing device, the drive member including an engagement surface which is operative to contact the cam surface during relative rotation of the first and second members and, during at least one selected angular displacement between the first and second positions, the contact between the cam surface and the engagement surface causes the drive member to move from extended position, wherein when the drive member is in the extended position the biasing arrangement is in an inactive mode such that it does not provide bias to the first or second members to undergo relative rotation.

Embodiment 4

A hinge mechanism according to embodiment 3, wherein, when in the active mode, the drive member is moved from its extended position and imparts a force to the cam surface that is offset from the hinge axis so as to induce a moment on the cam surface to bias the first and second members into relative rotation.

Embodiment 5

A hinge mechanism according to embodiment 3 or 4, wherein the engagement surface is profiled to include a recess to accommodate at least a portion of the cam to allow rotation of the cam relative to the engagement surface without biasing the drive member from the extended position during said first angular displacement of said first and second members.

Embodiment 6

A hinge mechanism according to any preceding embodiment, wherein the first member is in the form of a shaft and the second member is in the form of a housing, the shaft being disposed in the housing and rotatable relative thereto about the hinge axis.

Embodiment 7

A hinge mechanism according to any one of embodiments 3 to 6, wherein the drive arrangement is in the form of a piston cylinder arrangement, the piston forming the drive member and being movable within the cylinder along a piston axis which is arranged to be transverse to the hinge axis.

Embodiment 8

A hinge mechanism according to embodiment 7, wherein the biasing device is in the form of a compression spring disposed in the cylinder.

Embodiment 9

A hinge mechanism according to embodiment 7 or 8, wherein a stop arrangement is provided to prevent movement of the piston in the cylinder beyond the extended position.

Embodiment 10

A hinge mechanism according to embodiment 1, wherein when the biasing arrangement is in the inactive mode, a portion of the first member is received by a recess provided in the second member Embodiment 11

A hinge mechanism according to any preceding embodiment, wherein the first angular displacement is less than 85°

Embodiment 12

A hinge mechanism according to embodiment 11, wherein the first angular displacement is in the range of about 0 to 75°.

Embodiment 13

A hinge mechanism according to any preceding embodiment, wherein the second angular displacement is greater than 70°.

Embodiment 14

A hinge mechanism according to embodiment 13, wherein the second angular displacement is in the range of about 75° to 180°.

Embodiment 15

According to another embodiment, there is provided a hinge mechanism comprising:

first and second members rotatable relative to one another about a hinge axis from a first to a second position, and a biasing arrangement operative in an active mode to bias the first and second members into at least one relative position, the biasing arrangement comprises a cam surface disposed on the first member and a drive arrangement contained in the second member, the drive arrangement comprising a biasing device and a drive member which is biased into an extended position by the biasing device and movable from the extended position against the bias of the biasing device, the drive member including an engagement surface which is operative to contact the cam surface during relative rotation of the first and second members and, during at least one selected angular displacement between the first and second positions, the contact between the cam surface and the engagement surface causes the drive member to move from the extended position, wherein when the drive member is in the extended position the biasing arrangement is in an inactive mode such that it does not provide bias to the first or second members to undergo relative rotation, wherein the engagement surface is profiled to include a recess to accommodate at least a portion of a cam having the cam surface to allow rotation of the cam relative to the engagement surface without biasing the drive member from the extended position such that the biasing arrangement remains in the inactive mode on relative rotation of the first and second members through a first selected angular displacement and is in the active mode to bias the first and second members into at least one relative position through a second selected angular displacement.

Embodiment 16

According to a further embodiment, there is provided a hinge system comprising:

first and second hinge mechanisms for a barrier, each hinge mechanism comprising first and second members rotatable relative to one another about a hinge axis, one of the first or second members of each hinge mechanism being connected to the barrier and the other being connected to a supporting structure such that the barrier can rotate about the hinge axis, the hinge mechanisms each including a biasing arrangement operative in an active mode to bias their respective first and second members into a least one relative position and at least the first hinge mechanism is operative to adopt an inactive mode, where it does not provide bias to the first or second members to undergo relative rotation, through a selected angular displacement of the first and second members about the hinge axis, wherein the first and second hinge mechanisms are configured such that on rotation of the barrier about the hinge axis from the first position to the second position, at least one of the hinges mechanisms remain active to bias the barrier to return to the first position and wherein through a particular angular displacement between the first position and the second position at least the first hinge mechanism remains inactive.

Embodiment 17

A hinge system according to embodiment 16, wherein the second member of the first hinge mechanism comprises a recess for receiving a portion of the first member of the first hinge mechanism when the first hinge mechanism is in the inactive mode.

Embodiment 18

A hinge system according to embodiment 16 or 17, wherein the first and second hinge mechanisms are configured such that on rotation of the barrier about the hinge axis from a first position through a first angular displacement, the first hinge mechanism remains inactive whilst the second hinge mechanism is active to bias the barrier to return to the first position, whereas on continued rotation of the barrier through a second angular displacement, the first hinge mechanism is active to bias the barrier towards the first position.

Embodiment 19

A hinge mechanism according to any preceding embodiment, wherein the first angular displacement is less than 85°

Embodiment 20

A hinge mechanism according to embodiment 19, wherein the first angular displacement is in the range of about 0 to 75°.

Embodiment 21

A hinge mechanism according to any preceding embodiment, wherein the second angular displacement is greater than 70°.

Embodiment 22

A hinge mechanism according to embodiment 21, wherein the second angular displacement is in the range of about 75° to 180°.

Embodiment 23

A hinge system according to any one of embodiments 16 to 22 wherein the first hinge mechanism is as defined by any one of c embodiments 1 to 15.

In the claims which follow and in the preceding description, except where the context requires otherwise due to express language or necessary implication, the word "comprise" or variations such as "comprises" or "comprising" is used in an inclusive sense, i.e., to specify the presence of the stated features but not to preclude the presence or addition of further features in various embodiments of the hinge mechanism and hinge system.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope being indicated by the following claims.

What is claimed is:

1. A hinge mechanism comprising:

first and second members rotatable relative to one another about a hinge axis from a first to a second position; and a drive having a cam and a piston, the drive operative to adopt an active mode to bias the first and second members to rotate relative to one another into at least one relative position, and the drive operative to adopt an inactive mode where the drive permits free relative rotation between the first and second members without providing bias to the first or second members to undergo relative rotation, the cam having a cam surface disposed on the first member and the piston is provided on the second member, the piston being biased into an extended position and movable from the extended position against the bias, and the piston including an engagement surface which is operative to contact the cam surface during relative rotation of the first and second members, wherein the drive remains in the inactive mode on relative rotation of the first and second members through a first angular displacement between the first position and the second position, and is in the active mode on relative rotation of the first and second members through a second angular displacement between the first position and the second position, wherein during the first angular displacement of the first and second member between the first and second positions, the piston is in the extended position and the engagement surface is profiled to include a recess to accommodate at least a portion of the cam to allow the drive to be in the inactive mode and allow free rotation of the cam relative to the engagement surface without biasing the piston from the extended position, and during the second angular displacement of the first and second members between the first and second positions, the contact between the cam surface and the engagement surface allows the drive to be in the active mode and the piston moves from the extended position against the bias.

2. A hinge mechanism according to claim 1, wherein the drive remains in the inactive mode on relative rotation of the first and second members through the first angular displacement from the first position to an intermediate position and becomes active to bias the first and second members to the intermediate position on continued relative rotation of the first and second members through the second angular displacement from the intermediate position towards the second position.

3. A hinge mechanism according to claim 1, wherein when in the active mode, the piston is moved from its extended position and imparts a force to the cam surface that is offset from the hinge axis so as to induce a moment on the cam to bias the first and second members into relative rotation.

4. A hinge mechanism according to claim 1, wherein the first member is in the form of a shaft and the second member is in the form of a housing, the shaft being disposed in the housing and rotatable relative thereto about the hinge axis.

5. A hinge mechanism according to claim 1, wherein the piston is in the form of a piston cylinder arrangement, the piston being movable within a cylinder along a piston axis which is arranged to be transverse to the hinge axis.

6. A hinge mechanism according to claim 5, wherein the drive further comprises a resilient member disposed in the cylinder to bias the piston to the extended position.

7. A hinge mechanism according to claim 5, wherein a stop arrangement is provided to prevent movement of the piston in the cylinder beyond the extended position.

8. A hinge mechanism comprising:

first and second members rotatable relative to one another about a hinge axis from a first to a second position, and a drive operative in an active mode to bias the first and second members into at least one relative position, the drive comprises a cam surface disposed on the first member and a piston contained in the second member, the piston being biased into an extended position and movable from the extended position against the bias, the piston including an engagement surface which is operative to contact the cam surface during relative rotation of the first and second members and, during at least one selected angular displacement between the first and second positions, the contact between the cam surface and the engagement surface causes the piston to move from the extended position, wherein when the piston is in the extended position the drive is in an inactive mode such that it does not provide bias to the first or second members to undergo relative rotation, wherein the engagement surface is profiled to include a recess to accommodate at least a portion of a cam having the cam surface to allow rotation of the cam relative to the engagement surface without biasing the piston from the extended position such that the drive remains in the inactive mode on relative rotation of the first and second members through a first selected angular displacement and is in the active mode to bias the first and second members into at least one relative position through a second selected angular displacement.

9. A hinge system comprising:

first and second hinge mechanisms for a barrier, each hinge mechanism comprising first and second members rotatable relative to one another about a hinge axis, one of the first or second members of each hinge mechanism being connected to the barrier and the other of the first or second members being connected to a supporting structure such that the barrier can rotate about the hinge axis, the hinge mechanisms each including a drive operative in an active mode to bias their respective first and second members to rotate relative to one another into at least one relative position, the first hinge mechanism comprising the drive having a cam and a piston, the drive operative to adopt an active mode to bias the first and second members to rotate relative to one another into at least one relative position, and the drive operative to adopt an inactive mode where the drive permits free relative rotation between the first and second members without providing bias to the first or second members to undergo relative rotation, the cam having a cam surface disposed on the first member and the piston is provided on the second member, the piston being biased into an extended position and movable from the extended position against the bias, and the piston including an engagement surface which is operative to contact the cam surface during relative rotation of the first and second members, wherein the drive remains in the inactive mode on relative rotation of the first and second members through a first angular displacement between the first position and the second position, and is in the active mode on relative rotation of the first and second members through a second angular displacement between the first position and the second position, wherein during the first angular displacement of the first and second member between the first and second positions, the piston is in the extended position and the engagement surface is profiled to include a recess to accommodate at least a portion of the cam to allow the drive to be in the inactive mode and allow free rotation of the cam relative to the engagement surface without biasing the piston from the extended position, and during the second angular displacement of the first and second members between the first and second positions, the contact between the cam surface and the engagement surface allows the drive to be in the active mode and the piston moves from the extended position against the bias, wherein the first and second hinge mechanisms are configured such that on rotation of the barrier about the hinge axis from the first position to the second position, at least one of the hinges mechanisms remain active to bias the barrier to return to the first position and wherein through at least one of the angular displacements between the first position and the second position at least the first hinge mechanism remains inactive.

10. A hinge system according to claim 9, wherein the first and second hinge mechanisms are configured such that on rotation of the barrier about the hinge axis from the first position through the first angular displacement, the first hinge mechanism remains inactive whilst the second hinge mechanism is active to bias the barrier to return to the first position, whereas on continued rotation of the barrier through the second angular displacement, the first hinge mechanism is active to bias the barrier towards the first position.

* * * * *